US010927861B2

(12) United States Patent
Neef et al.

(10) Patent No.: US 10,927,861 B2
(45) Date of Patent: Feb. 23, 2021

(54) ELECTROPNEUMATIC CONTROLLER AND PROCESS CONTROL DEVICE EQUIPPED THEREWITH

(71) Applicant: Festo SE & Co. KG, Esslingen (DE)

(72) Inventors: Bodo Neef, Neuhausen (DE); Christoph Maile, Hochdorf (DE)

(73) Assignee: FESTO SE & CO. KG, Esslingen (DE)

( * ) Notice: Subject to any disclaimer, the term of this patent is extended or adjusted under 35 U.S.C. 154(b) by 0 days.

(21) Appl. No.: 16/608,539

(22) PCT Filed: May 3, 2017

(86) PCT No.: PCT/EP2017/060520
§ 371 (c)(1),
(2) Date: Oct. 25, 2019

(87) PCT Pub. No.: WO2018/202291
PCT Pub. Date: Nov. 8, 2018

(65) Prior Publication Data

US 2020/0200198 A1 Jun. 25, 2020

(51) Int. Cl.

| | |
|---|---|
| ***F15B 15/20*** | (2006.01) |
| ***F15B 13/08*** | (2006.01) |
| *F15B 5/00* | (2006.01) |
| *F15B 21/00* | (2006.01) |
| *F15B 13/00* | (2006.01) |

(52) U.S. Cl.
CPC ..... *F15B 15/202* (2013.01); *F15B 13/0839* (2013.01); *F15B 5/006* (2013.01); *F15B 21/003* (2013.01); *F15B 2013/006* (2013.01); *F15B 2211/6336* (2013.01); *F15B 2211/6656* (2013.01)

(58) Field of Classification Search
CPC ..... F15B 2211/6336; F15B 15/202; F15B 13/0839; F15B 5/006; F15B 2211/6656
See application file for complete search history.

(56) References Cited

U.S. PATENT DOCUMENTS

| | | | | |
|---|---|---|---|---|
| 5,457,594 | A | 10/1995 | Stoll et al. | |
| 2012/0179423 | A1* | 7/2012 | Robl | G05B 19/408 702/188 |
| 2016/0062368 | A1* | 3/2016 | Wagner-Stuerz | F15B 20/008 700/282 |
| 2018/0245608 | A1* | 8/2018 | Doll | F15B 11/04 |

FOREIGN PATENT DOCUMENTS

| | | | |
|---|---|---|---|
| CN | 101109401 | A | 1/2008 |
| CN | 102041770 | A | 5/2011 |
| CN | 103380304 | A | 10/2013 |
| DE | 19636418 | A1 | 3/1998 |

(Continued)

*Primary Examiner* — Abiy Teka
(74) *Attorney, Agent, or Firm* — Hoffmann & Baron, LLP

(57) ABSTRACT

An electropneumatic control apparatus, which has a carrier module, on which a control unit, which is equipped with control electronics and control valve elements, and an expansion module assembly, which has at least one expansion module, are installed independently of each other. By means of a drive fastening interface, the control apparatus can be installed on the actuating drive to be controlled, in order to form a process control device.

20 Claims, 2 Drawing Sheets

(56) References Cited

FOREIGN PATENT DOCUMENTS

| | | | | |
|---|---|---|---|---|
| DE | 10350305 | A1 | 5/2005 | |
| FR | 2403479 | A1 | 4/1979 | |
| JP | H0949502 | A | 2/1997 | |
| WO | 2012032296 | A1 | 3/2012 | |
| WO | WO-2012032296 | A1 * | 3/2012 | ..... F15B 15/149 |

* cited by examiner

ELECTROPNEUMATIC CONTROLLER AND PROCESS CONTROL DEVICE EQUIPPED THEREWITH

This application claims priority based on an International Application filed under the Patent Cooperation Treaty, PCT/EP2017/060520, filed on May 3, 2017.

BACKGROUND OF THE INVENTION

The invention relates to an electropneumatic controller, which is designed to control a pneumatic actuator, comprising an actuator mounting interface designed for mounting on the pneumatic actuator to be controlled, further comprising an electropneumatic control unit, which contains a control electronics designed to process feedback signals of the actuator and control valve means electrically actuatable by the control electronics, and comprising at least one working channel, which, on the one hand, is connected to the control valve means and, on the other hand, has a main working outlet serving to pneumatically connect to an actuating chamber of the actuator to be controlled. The invention further relates to a process control device equipped with a controller of this type.

A pneumatic actuator is known from DE 19636418 A1 that is equipped with an electropneumatic controller of the aforementioned type, which has an electropneumatic control unit formed as a positioner. The control unit has at least one main pneumatic working outlet that is connected to an actuating chamber of the pneumatic actuator. Depending on feedback signals received from the actuator, which depend on the position of a drive rod of the actuator, a controlled pressure impact occurs in the actuating chamber in order to regulate the position of the actuator rod. The positioner is formed internally in a modular manner and can be equipped inside its housing optionally with different functional units in order to be able to change the type of positioner between pneumatic, electropneumatic and digital.

SUMMARY OF THE INVENTION

The object underlying the invention is to take measures that enable a simple variation of the functionality of the electropneumatic controller, maintaining compact dimensions, and a process control device equipped therewith.

In order to achieve this object, provision is made in the case of an electropneumatic controller of the type mentioned at the outset to have a carrier module which comprises a control unit interface and an extension interface separated in this regard, wherein the control unit is mounted on the control unit interface and wherein an extension module arrangement having at least one extension module is mounted on the extension interface independently of the control unit, said extension module arrangement also being passed through by the at least one working channel like the carrier module.

The object is further achieved by a process control device that is equipped with an actuator and an electropneumatic controller for the actuator, wherein the controller is designed in the above-mentioned sense and is installed on the actuator with its actuator mounting interface.

In this way, it is possible to adapt the functionality of an electropneumatic controller individually and independently of the control unit to the respective application case. The pure controlling function is assumed by the control unit, additional functions desired beyond this can be provided by the extension module arrangement. The separated interfaces for the control unit and for the extension module arrangement allow manipulations both on the control unit and on the extension module arrangement without the respectively other component being influenced. For example, extension modules with different functionality can be exchanged or supplemented without the control unit having to be removed. Similarly, in the case of a preferably detachable mounting, the control unit can be removed or exchanged temporarily for maintenance purposes or other reasons, without the carrier module with the extension module arrangement arranged thereon having to be removed from an actuator carrying the controller. Since the working channel passes through not only the carrier module, but also the extension module arrangement, it is possible to influence the pressurised air to be supplied to the actuator or flowing back from the actuator by correspondingly equipping the extension module arrangement without modifications having to be performed on the control unit.

Advantageous further developments of the invention are described in the dependent claims.

For the actuation of a single-acting pneumatic actuator, the controller can be equipped with only one single working channel and accordingly only one single main working outlet. In order to actuate a double-acting actuator, the working channel and accordingly also the main working outlet is present in duplicate. It is also possible to use a controller equipped with two working channels and two main working outlets by not using one of these working channels for the actuation of an only single-acting actuator. The actuatable actuator can for example be a rotary actuator or a linear actuator, for example a piston actuator or a diaphragm actuator.

A configuration of this kind is in principle possible such that the actuator mounting interface is located on the extension module arrangement and in particular on one of the extension modules. This allows such an arrangement of the controller on an actuator that the extension module arrangement is integrated between the carrier module and the actuator. For the handling and in particular the supplementing or exchange of extension modules, an embodiment is also advantageous, in the case of which the actuator mounting interface, like the extension interfaces formed separately in each case in this regard, and control unit interface are also arranged on the carrier module. The carrier module has, in this case, three interfaces, on the one hand, to install the control unit and, on the other hand, to install the extension module arrangement and, on the other hand, to assemble the controller on an actuator.

The main working outlet of each working channel is preferably formed on the carrier module. This is in particular the case when the carrier module has the actuator mounting interface since it is advantageously possible to provide the main working outlet on the actuator mounting interface. This is associated in particular with the possibility of providing a direct pressurised air connection between the carrier module and the actuator by installing the carrier module on the actuator. Using such an adaptation, the use and assembly of separate pressurised air lines or pressurised air hoses is avoided.

For the design of the carrier module, any shapes can essentially be considered. An L-shaped design has been found to be particularly expedient, in the case of which the carrier module has two carrier module limbs arranged at right angles to one another, which are in particular uneven in length. The two carrier module limbs delimit, together with their inner surfaces forming an angle of 90°, a receiving region for the control unit, wherein the control unit interface is formed on the inner surface of at least one of the carrier module limbs. The extension interface is located in this case on the outer surface of one of the carrier module limbs facing away from the receiving region.

It is considered expedient to provide a mounting option for the control unit on both carrier module limbs. In this case, the control unit interface is composed of two interface sections, which are arranged in each case on the inner surface of one of the two carrier module limbs. Fluid connections of the at least one working channel expediently communicating with the installed control unit are located on one of the interface sections, while the other interface section has no fluid connections and is expediently used purely for the mechanical fixing of the control unit. In particular, the carrier module limb assigned to this interface section comprises the actuator mounting interface.

Each working channel expediently passes through at least one of the carrier module limbs. If the control unit interface and the extension interface are located on inner and outer surfaces of a carrier module limb opposed to one another, longitudinal sections of the working channel running therein can pass through the carrier module limb in question in a straight line.

It is advantageous when, in the case of an L-shaped carrier module, both carrier module limbs are used for pressurised air guidance and in particular to include in each case a longitudinal section of each working channel. In this case, it is advantageous for the extension interface to be formed on the outer surface of the one carrier module limb and the main working outlet of at least one and preferably each working channel to be formed on the outer surface of the other carrier module limb. The outer surface having the at least one main working outlet preferably also defines the actuator mounting interface of the carrier module.

The control unit expediently has a housing, which is designated as the control unit housing to better distinguish it and which defines an inner space, in which the control electronics and the control valve means are housed in a manner shielded from the environment. In the case of corresponding equipping of the control unit, feedback means serving to generate feedback signals of the actuator can also be located in this control unit housing, for example a potentiometer device or sensor arrangement.

The sensor electronics expediently has at least one feedback signal input suitable for receiving feedback signals of the actuator. The feedback signals can be fed into the control unit from outside of the control unit or can also be generated in the interior of the control unit in the case of corresponding equipping, said control unit having in this case suitable feedback means.

If feedback means are provided in the control unit housing for outputting feedback signals of the actuator, it is expedient for the carrier module to have a through-hole through which a feedback member movement-coupled to a movable actuating unit of the actuator or formed directly by such an actuating unit protrudes into the control unit, which cooperates with the feedback means. Such a feedback member is for example formed by a displaceable rod or a rotatable shaft.

Different functional characteristics are considered for the control unit. The control unit can for example be designed for unregulated actuation of the control valve means, wherein simple sensor signals that are generated depending on certain positions of an actuating unit of the actuator are fed into it as feedback signals. Particularly advantageous is an embodiment of the control unit as a positioner unit that could also be called a positioner, the control electronics of which has a regulation functionality in order to operate the actuator in a regulated manner, in particular by regulating the position of a mobile actuating unit of the actuator. The control electronics of the positioner unit has a set value input by means of which it is connected to an external electronic control device, which can predefine the set values. The position regulation unit then uses these to regulate the position of the connected actuator.

The electrically actuatable control valve means can consist of just one control valve or a group of control valves. The control valve means preferably have a constant functional characteristic or are designed for pulse width modulated operation. They can be designed for direct actuation by means of the control signals provided by the control electronics or can be of an electropneumatically pre-controlled construction type. It is advantageous if the positioner unit contains an e/p converter as a pre-control stage which in particular works according to the nozzle deflector plate principle.

Expediently, the extension module arrangement is passed through by a longitudinal section of each working channel, which is designated as the extension working channel and which has two end sections, which both open out to the side of the extension module arrangement facing the extension interface of the carrier module. In this way, the pressurised air to be supplied to the actuator is virtually looped through the extension module arrangement. This provides the advantageous option of influencing the pressurised air when flowing through the extension module arrangement by correspondingly equipped extension modules of the extension module arrangement. The extension working channel communicates on the extension interface, on the one hand, with a pneumatic extension working outlet connected to the control valve means and, on the other hand, with an extension working inlet connected to the pneumatic main working outlet. Both the extension working outlet and the extension working inlet are arranged on the extension interface of the carrier module.

An extension module of the extension module arrangement is preferably formed as a diverting module diverting the extension working channel from the extension working outlet back to the extension working inlet. This diverting modules terminates the extension module arrangement expediently on the side opposite the control unit as an end module.

At least one extension module of the extension module arrangement is expediently formed as a functional module, by means of which the pressurised air flowing in the extension module arrangement during operation of the controller can be influenced, for example by filtering, pressure regulation or pressure boosting. At least one functional module can, additionally or alternatively, also be designed such that it can be influenced by the pressurised air flowing through it, for example to display status variables such as pressure or flow. The extension module arrangement can have a plurality of functional modules in series with functionalities distinct from one another.

If the extension module arrangement contains a diverting module, it is possible to form all functional modules separately to the diverting module or also design the deflection as a functional module. It lends itself in particular here for the diverting module to be formed as an air input module to feed in the pressurised air required for the operation of the actuator.

The number of functional modules contained in the extension module arrangement is any desired number and in particular its sequence is also any desired. The functional modules used are in particular selectable in any combination of a group of functional modules which comprises at least one air treatment module, a display module, a restrictor module, an interruption module, a manual actuation module, an emergency shut-off module, a booster module and an air input module.

If, in the case of a special application case, no influence is required on the pressurised air via the controlling or regulation functionality of the control unit, the functional modules inside the extension module arrangement can be dispensed with, which is composed of only one single extension module placed on the carrier module, in the case of which it is in particular a diverting module.

The controller has at least one air input connection, via which the pressurised air can be supplied, which is guided by cooperation of the control valve means to the actuator or guided away from the actuator. The pressurised air can also be used as control auxiliary air for the operation of electro-pneumatically pre-controlled control valve means and optionally also for the operation of pressure-sensitive functional means of the extension modules, for example integrated valve apparatuses of these extension modules.

An air input connection can be provided directly on the carrier module. There is also the additional or alternative option of forming at least one air input connection on the extension module arrangement. Each air input connection expediently communicates with a longitudinal section of an air supply channel, which is designated as extension air supply channel and which passes through the extension module arrangement. The extension air supply channel is connected through the carrier module to the control valve means, located in the control unit, to the pressurized air supply. The carrier module and the control unit, for this purpose, have corresponding longitudinal sections of the air supply channel.

A process control device having the electropneumatic controller and an actuator can be used for controlling any processes. In a preferred configuration, the process control device comprises a process valve, which has a valve fitting fitted with the actuator, which is switched on in the course of a pipeline of a, for example, biological, chemical or biochemical system in order to be able to regulate the flow of a process medium.

BRIEF DESCRIPTION OF THE DRAWINGS

The invention is explained in more detail below with reference to the attached drawing, in which.

DETAILED DESCRIPTION

Figure 1:
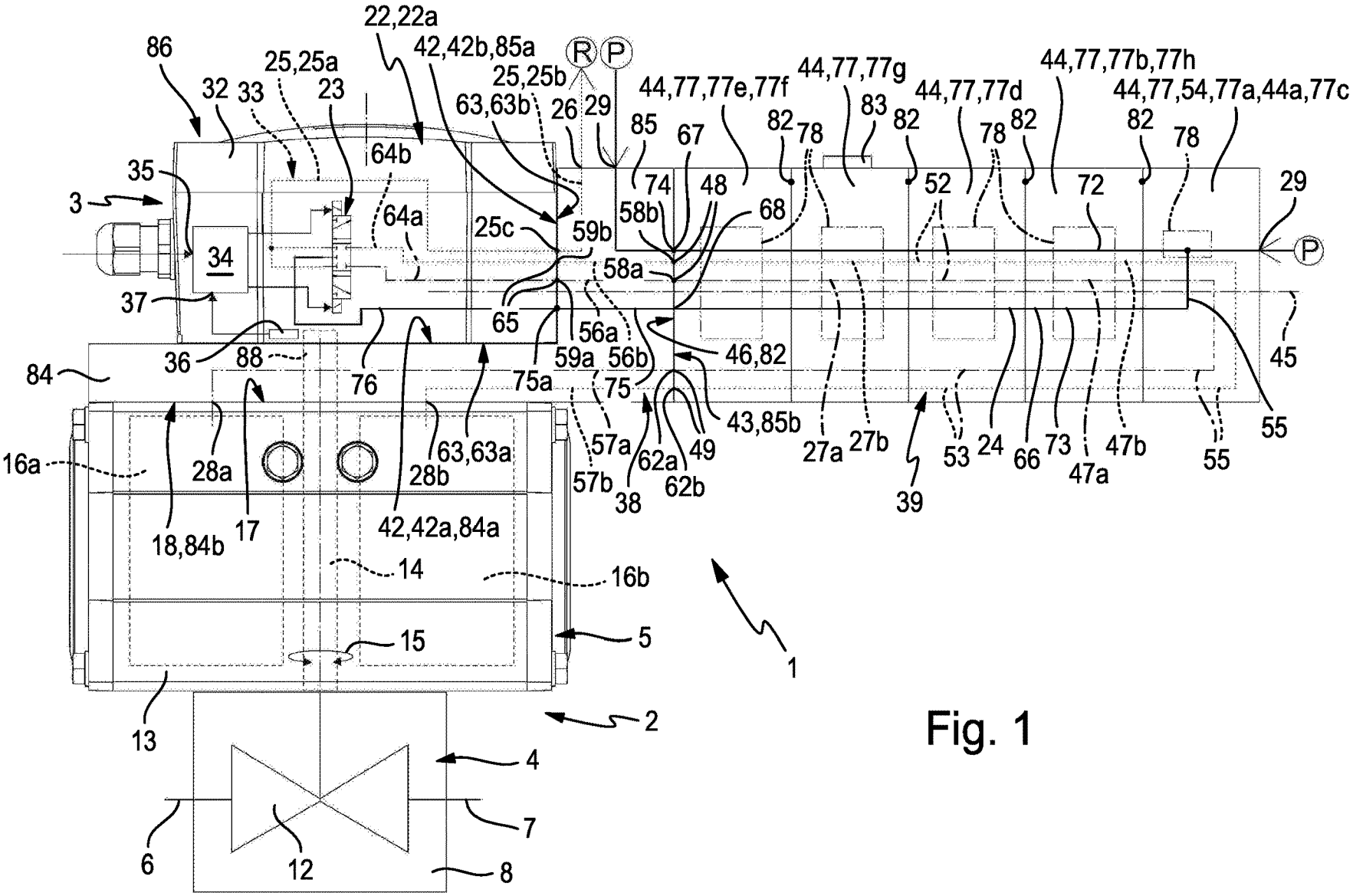
FIG. 1 shows, in a side view, a preferred embodiment of the process control device according to the invention, which is equipped with a similarly preferred embodiment of an electropneumatic controller according to the invention, wherein the electric and fluidic wiring is indicated only schematically.
Figure 2:
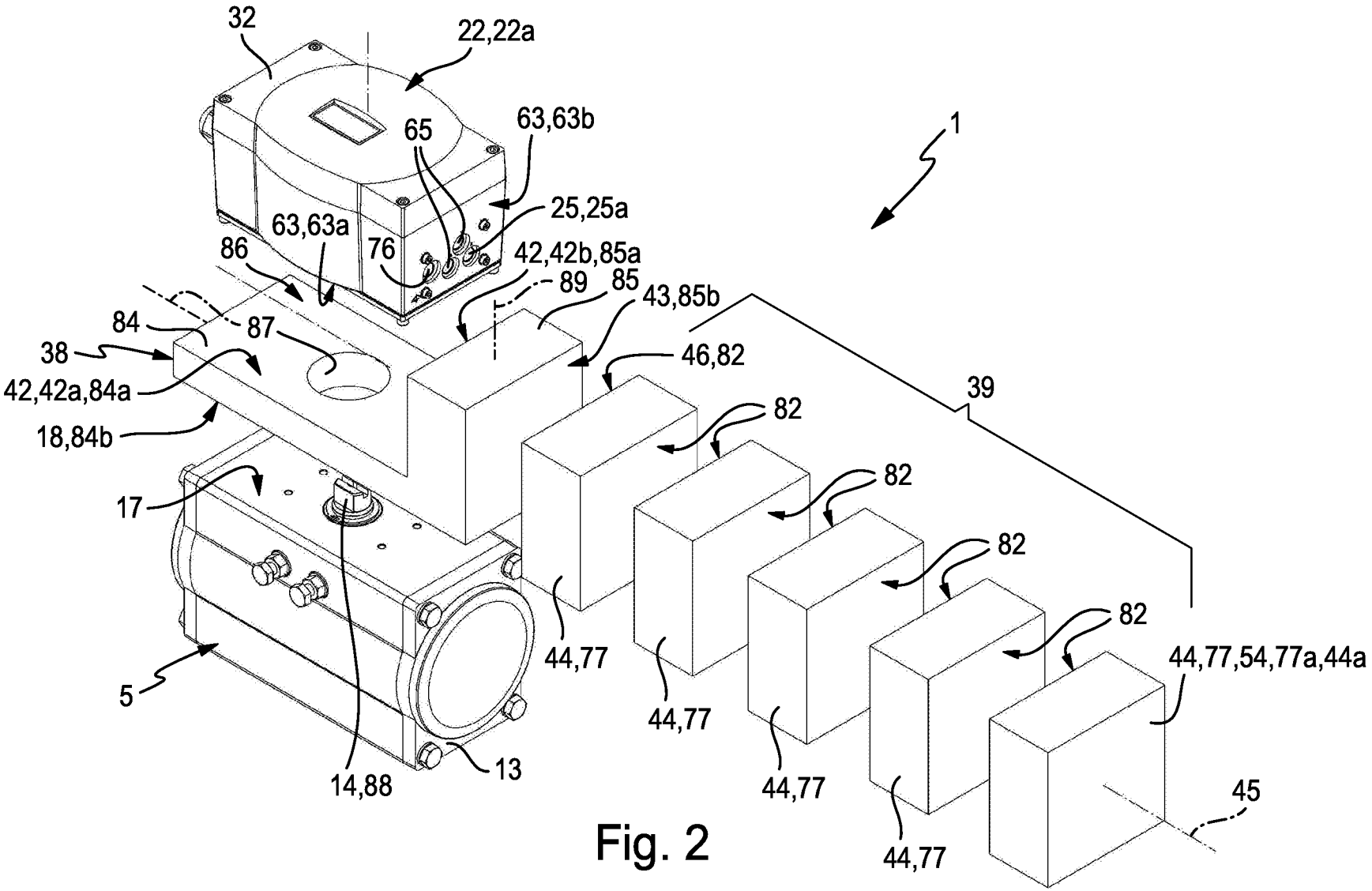
FIG. 2 shows the arrangement from FIG. 1 in a perspective exploded representation.

The process control device designated in its entirety with reference numeral 1 has a process valve 2 and an electro-pneumatic controller 3 installed on the process valve 2 in a preferably detachable manner.

The process valve 2 has a valve fitting 4 indicated only schematically and a pneumatic actuator 5 combined with the valve fitting 4 to form an assembly.

The valve fitting 4 has at least two fitting connections 6, 7 for incorporation into a pipeline and has a valve seat 12 arranged in a fitting housing 8, which is positionable in different positions in order to shut off a fluid connection between the two fitting connections 6, 7 or to releases it with variable cross-section.

The pneumatic actuator 5 has an actuator housing 13 by means of which it is installed on the fitting housing 8. A movable actuating unit 14 extends in the actuator housing 13, said actuating unit being movement-coupled to the valve seat 12 and which can be prompted by pneumatic actuation of the actuator 5 into an actuating movement 15 indicated by a double arrow, by way of which the position of the valve seat 12 can be changed.

By way of an example, the actuator 5 is designed as a rotary actuator in which the actuating movement 15 of the actuating unit 14 is a rotary movement. Two first and second actuating chambers 16*a*, 16*b* indicated only schematically are formed in the interior of the actuator housing 13, which are delimited in each case by an actuating piston coupled to the actuating unit 14 by means of actuator technology or belonging to the actuating unit 14 such that the actuating movement 15 can be initiated in one or another direction by a supply and discharge of pressurised air matched to one another. By setting corresponding pressure ratios in the actuating chambers 16*a*, 16*b*, the actuating unit 14 and therefore the valve seat 12 can also be positioned in any position with no graduations.

According to an exemplary embodiment not illustrated, the actuator 5 can also be a linear actuator. In this case, a flat slide is generally provided as a valve seat 12, while the valve seat 12 in the exemplary embodiment is a rotary vane.

An assembly interface 17 is formed on the actuator 5, in particular externally on its actuator housing 13, on which assembly interface the controller 3 is detachably installed with a mounting interface formed thereon and designated as the actuator mounting interface 18 to better distinguish it. Fastening means used for fastening such as for example fastening screws are not shown in the drawing.

The controller 3 has a control unit 22 that is consistently manageable in the removed state, which is equipped with electrically actuatable control valve means 23 that can be activated by such actuation. An air supply channel 24 of the controller 3 is connected to the control valve means 23 in which pressurised air can be fed in via at least one air input connection 29 arranged on the external surface of the controller 3, said pressurised air being provided by an external pressurised air source P.

The control valve means 23 are also connected to an air outlet channel 25 of the controller 3, which is drawn in FIG. 1 with a dotted line and which opens out via at least one air outlet opening 26 on an external surface of the controller 3 to the atmosphere R.

While the compressed air needed to operate the actuator 5 is supplied via the air supply channel 24, air is removed from the actuator 5 by means of the air outlet channel 25. If necessary, quick venting valve means can also still be present to increase the venting flow rate.

Two pneumatic working channels are also connected to the control valve means 23, which are designated as first and second working channel 27*a*, 27*b* to better distinguish them, and which are drawn in the drawing in one case as a dot-dashed line and in the other case as a dotted line to better distinguish them. Each working channel 27*a*, 27*b* passes through the controller 3 and opens out at the actuator mounting interface 18. The channel mouths of the working channels 27*a*, 27*b* located there are designed as first main working outlet 28*a* and as second main working outlet 28*b*.

By way of example, the controller 3 is adapted to the actuator 5 such that the two main working outlets 28*a*, 28*b* communicate, in the state of the controller 3 fastened to the actuator mounting interface 18 on the assembly interface 17, directly with fluid channels formed in the actuator housing 13, which open into the working chambers 16*a*, 16*b*. Therefore, the fluid connection between the controller 3 and the actuator 5 can take place without any separate pipelines or hose lines. The fluid connection is automatically formed or separated again when assembling and dismantling the controller 3.

According to an exemplary embodiment not illustrated, the main working outlets 28*a*, 28*b* can also be provided on the controller 3 away from the actuator mounting interface 18 such that they are connected fluidically to the actuator 5 with suitable pipelines or hose lines independently of the fastening of the controller 3.

The control unit 22 has a control unit housing 32 which encloses a receiving space 33 in a manner shielded from the environment. The control valve means 23 and also a control electronics 34 connected by actuation technology to the control valve means 23 are located in the receiving space 33. The control electronics 34 provides electrical control signals for the control valve means 23 to specify their operating status. Depending on the operating status currently set out, the control valve means 23 provide a fluid connection of one or both working channels 27*a*, 27*b* to either the air supply channel 24 or the air outlet channel 25 or they separate both working channels 27*a*, 27*b* both from the air supply channel 24 and the air outlet channel 25. In this way, pressurised air can be fed into each working chamber 16*a*, 16*b* or removed from each working chamber 16*a*, 16*b* and it is also possible to lock the pressurised air in the working chambers 16*a*, 16*b*. In this way the actuating movement 15 can be initiated in one direction or the other or be stopped at any point.

The control valve means 23 of the exemplary embodiment are designed as proportional valve means and consequently permit a constant change in the flow cross section that is released or shut off. By way of an example, the control valve means 23 have a 5/3 valve function.

An alternative embodiment of the control valve means 23 (not shown) contains several switching valves that can be actuated in a pulse width modulated manner.

The control valve means 23 can for example be designed as magnetic valve means or as piezo valve means for their electrical activation ability. They can be directly electrically actuated but are preferably of an electropneumatically pre-controlled construction type in line with the exemplary embodiment. Electrically actuatable pre-control valve means in the control valve means 23 can for example be designed as e/p converters according to the nozzle-deflecting plate principle.

The control electronics 34 expediently has a closed-loop control functionality, which is the case in the exemplary embodiment. This makes regulated operation of the actuator 5 possible, in particular operation in which the position is regulated. In this case, the control unit 22 also represents a positioner unit 23*b* that can also be called a positioner.

The control electronics 34 has a set value input 35, by means of which set value signals can be supplied externally, which correspond to the desired set position of the valve seat 12. In order to do this, the set value input 35 is connected to an external electronic controller (not shown).

The knowledge of the actual position of the valve seat 12 needed to regulate the position is created for the control electronics 34 in the form of feedback means 36 that cooperate with the actuator 5 and more precisely with its actuating unit 14 and are connected to a feedback signal input 37 of the control electronics 34. The feedback means 36 are able to provide continuous position information on the actuating unit 14 to the control electronics 34 as electrical signals. By way of example, the feedback means 36 are formed by a potentiometer device, which is actuated when the actuating unit 14 rotates. In the case of an actuator 5 formed as a linear actuator, the feedback means 36 are expediently formed by a linear displacement measuring apparatus.

Depending on the result of the comparison between the set values supplied to the control electronics 34 and the actual values, the control valve means 23 are electrically actuated by the control electronics 34 to actuate the actuator 5 accordingly.

In a simpler embodiment, the control electronics 34 does not have a closed-loop control function so it can only carry out unregulated actuation of the actuator 5, wherein singular sensor signals are processed in particular as feedback signals.

The controller 3 also contains, aside from the control unit 22, a carrier module 38 and an extension module arrangement 39.

The carrier module 38 acts as a mechanical and fluidic interface member between the control unit 22, the actuator 5 and the extension module arrangement 39. The actuator mounting interface 18 is formed on the carrier module and also has a control unit interface 42 used for fastening the control unit 22 and an extension interface 43 used for fastening the extension module arrangement 39.

The extension module arrangement 39 is composed of, in principle, any number of extension modules 44, which are joined together in a preferably linear series direction 45 indicated by a dot-dashed line and fixed to one another.

The extension module arrangement 39 is attached to the extension interface 43 with a module mounting interface 46 oriented in the series direction 45 and fastened detachably to the carrier module 38. The module mounting interface 46 is located in each case on the extension module 44, which is attached directly to the carrier module 38.

Both the control unit 22 and the extension module arrangement 39 are preferably fastened detachably on the carrier module 38. Fastening means used for this purpose are not shown in the drawing. The fixing of the control unit 22 and the extension module arrangement 39 on the carrier module 38 takes place independently of one another.

The two working channels 27*a*, 27*b* pass through both the carrier module 38 and the extension module arrangement 39. The longitudinal sections of the working channels 27*a*, 27*b* extending through the extension module arrangement 39 are designated as first extension working channel 47*a* and as second extension working channel 47*b* to better distinguish them. Each of these extension working channels 47*a*, 47*b* opens, at one end, with an input connection 48 and, at the other end, with an output connection 49 on the module mounting interface 46. Aside from the last extension module 44 opposite the carrier module 38, which ends the extension module 39 as the end module 44*a*, all extension modules 44 are preferably passed through twice by each extension working channel 47*a*, 47*b* and namely, by an input channel branch 52 connecting to the respective input connection 48 and an output channel branch 53 connecting to the output connection 49.

The extension module 44 ending the extension module arrangement 39 as end module 44*a* on the side opposed to the carrier module 38 is preferably formed as a diverting module 54, in which a deflection channel section 55 of each extension working channel 47*a*, 47*b* extends, which in each case connects one of the input channel branches 52 to one of the output channel branches 53.

In this way, each extension working channel 47*a*, 47*b* preferably has in total one U-shaped channel course.

The carrier module 38 is passed through by two first carrier module channel sections 56*a*, 56*b* which open out with a first extension working outlet 58*a* and a second extension working outlet 58*b* on the extension interface 43 such that they communicate with in each case one of the input connections 48 of the extension module arrangement 39. These first carrier module channel sections 56*a*, 56*b* open, on the other side, with each input connection 59*a*, 59*b* on the control unit interface 42.

The carrier module 38 is also passed through by two second carrier module channel sections 57*a*, 57*b* defining in each case a longitudinal section of the working channels 27*a*, 27*b*, which open out in each case via a first or second extension working inlet 62*a*, 62*b* on the extension interface 43 such that they meet with and are fluidically connected to one of the output connections 49 in each case. The second carrier module channel sections 57*a*, 57*b* open out, at the other end, forming the two main working outlets 28*a*, 28*b* on the actuator mounting interface 18.

The control unit 22 has, externally on its control unit housing 32, an installation interface 63 by means of which it abuts on its control unit interface 42 in the state assembled on the carrier module 38. Longitudinal sections of the working channels 27*a*, 27*b* open out at this installation interface 63 with channel mouths 65, said longitudinal sections of the working channels are designated as first and second control unit working channels 64*a*, 64*b* and which are connected in the control unit 22 to the control valve means 23. These channel mouths 65 are placed such that they meet with and are connected to in each case one of the input connections 59*a*, 59*b* in the state of the control unit 22 assembled on the control unit interface 42 of the carrier module 38.

As a result, a continuous fluid connection of the working channels 27*a*, 27*b* results between the control valve means 23 and the main working outlets 28*a*, 28*b*.

In the case of the illustrated and preferred exemplary embodiment, the air supply channel 24 extends with a U-shaped longitudinal section, which is designated as extension air supply channel 66, in the extension module arrangement 39, and namely proceeding from an input connection 67 located on the module mounting interface 46 to an output connection 68 also located on this module mounting interface 46. The extension air supply channel 66 has an input channel branch 72, which extends proceeding from the input connection 67 through all extension modules 44 into the diverting module 54 where the extension air supply channel 66 is deflected via a further deflection channel section 55 and merges into an output channel branch 73 extending to the output connection 68. An air input connection 29 formed on the diverting module 54 in the case of the exemplary embodiment is expediently connected to the extension air supply channel 66 inside the diverting module 54.

An air input connection 29 formed additionally or alternatively on the carrier module 38 is connected to a longitudinal section of the air supply channel 24 running in the carrier module 38, said longitudinal section of the air supply channel ends with an extension supply input 74 on the extension interface 43, which is aligned and connected to the input connection 67. As a result, pressurised air input at the carrier module 38 can be guided through the carrier module 38 such that it flows through each carrier module 38 twice, on the one hand, in the input channel branch 72 and, on the other hand, in the output channel branch 73. This provides optimal possibilities for individually using the pressurised air for functions of the controller 3 inside the extension modules 44.

The connection of the air supply channel 24 to the control valve means 23 expediently takes place through a carrier module channel section 75 connected to the output connection 68 and passing through the carrier module 38, said carrier module channel section merging into a control unit channel section 76 extending in the control unit 22 to the control valve means 23 in a transition region 75*a* on the control unit interface 42.

In the case of a simpler embodiment of the controller 3, the longitudinal section of the air input channel 24 connecting to the air input connection 29 of the carrier module 38 runs without connection to the extension module arrangement 39 directly to the control unit interface 32 in order to merge into the control unit channel section 76 there.

The air outlet channel 25 already mentioned above expediently has a first channel section 25*a* running in the control unit 22 proceeding from the control valve means 23 to the installation interface 63, said first channel section being connected in a transition region 25*c* to a second channel section 25 of the air outlet channel 25 opening out at the control unit interface 42, said air outlet channel running inside the carrier module 38 to the air outlet opening 26 also formed on the carrier module 38.

Deviating from the illustrated exemplary embodiment, the air outlet channel 25 can also extend through the extension module arrangement 39 such that it can be used for venting functions by functional means 78 present in the extension modules 44. In a manner not shown, at least one extension module 44 can have an air outlet opening 26 connected to the air outlet channel 25 in addition or alternatively to the carrier module 38.

At least one extension module 44 is expediently formed as a functional module 77, which has functional means 78 only schematically indicated which are capable of influencing the pressurised air flowing in the extension module arrangement 39 during operation of the controller 3 and/or are formed to be able to, in turn, influence pressurised air flowing through it.

In the case of the exemplary embodiment, all extension modules 44 are formed as functional module 78. With respect to the diverting module 54, there is the particularity of it also acting as a functional module 77. The functional means 78 integrated into the diverting module 54 are preferably designed as air preparation means, which in particular contain a filter and/or a pressure regulator such that the diverting module 54 also represents an air treatment module 77*a*.

The diverting module 54 can alternatively also be formed such that it only serves for pressurised air deflection inside the extension module arrangement 39 and has no separate functional means 78.

If no particular functionality is desired for the extension module arrangement 39 due to a corresponding application case, all other extension modules 44 can be omitted aside from the diverting module 54. The diverting module 54 is then installed directly on the extension interface 43 as an end module 44*a*.

Aside from the extension module 44 acting as the end module 44*a*, all extension modules 44 expediently have in each case a coupling interface 82 on their front surfaces opposed to one another in the series direction 45, wherein the coupling interfaces 82 are matched to one another such that the extension modules 44 can be installed on one another ensuring a mutual fluid connection, in particular in any sequence. The extension working channels 47*a*, 47*b* of the optionally present extension air supply channel 66 and, if present, a channel section of an air outlet channel 25 extending through the extension module arrangement 39 are composed of channel longitudinal sections which pass through the extension modules 44 incorporated between the carrier module 38 and the end module 44*a* between their two axially aligned coupling interfaces 82 and communicate with one another on the coupling interfaces 82. In addition to this are the deflection channel sections 55 of the diverting module 54 used as the end module 44*a*, which preferably, but not necessarily, has a coupling interface 82 only on the front surface pointing to the carrier module 38.

In each case the coupling interface 82 of the extension module 44 acts as the module mounting interface 46, which is attached directly to the extension interface 43 of the carrier module 38.

The extension modules 44 are preferably fastened to one another detachably and on the carrier module 38. Fastening means provided for this purpose can be formed such that in each case two extension modules 44 immediately after one another can be fixed to one another independently of the other extension modules 44, wherein the extension module 44 following the carrier module 38 is individually fixed to the carrier module 38. The fastening means can, however, also be designed such that, using said fastening means, all extension modules 44 can be fixed or are fixed together on the carrier module 38, for example by tension anchors.

As already mentioned, the extension module arrangement 39 can contain any number of functional modules 77 installed next to one another in any sequence.

A possible characteristic of a functional module 77 is that of an air treatment module 77*a*.

At least one functional module 77 can be a restrictor module 77*b*, which is equipped with unchangeable or with settable throttle means as the functional means 78, which limit the flow.

At least one functional module 77 can be an air input module 77*c* which has an air input connection 29. By way of example, the end module 44*a* also forms such an air input module 77*c*.

At least one functional module 77 can be a booster module 77*d* by means of which the volume flow of the pressurised air flowing through the working channels 27*a*, 27*b* to the actuator 5 can be boosted. The booster module 77*d* contains, as the functional means 78, at least one booster circuit constructed from valve means, which are connected in the interior of the booster module 77*d* not only with extension working channels 47*a*, 47*b*, but also with the extension air supply channel 66.

At least one functional module 77 can be an interruption module 77*e*, through which all fluid channels can be interrupted or shut off so that for example the control unit 22 can be removed, without the air supply to the controller 3 having to be shut off.

At least one functional module 77 can be a manual actuation module 77*f* by means of which an actuation of the actuator 5 independent of the control unit 22 can be performed in the case of maintenance or construction measures. By way of example, one of the functional modules 77 is combined as the interruption module 77*e* and formed as manual actuation module 77*f*.

At least one functional module 77 can be an emergency shut-off module 77*g*, which can receive external electric emergency shut-off signals via an electric interface 83 and initiates for example a venting operation of the actuator 5.

At least one functional module 77 can be formed as a display module 77*h* by means of which one or a plurality of status variables of the pressurised air can be visually displayed, in particular the nominal pressure available in the air supply channel 24 and/or the working pressure available in at least one of the working channels 27*a*, 27*b*. By way of example, one of the functional modules 77 is combined as a restrictor module 77*b* and formed as display module 77*h*.

The extension modules 44 are expediently formed in a block-shaped, plate-shaped or disc-shaped manner. All extension modules 44 expediently have the same contours in a plane at right angles to the series direction 45. The extension modules 44 in the series direction 45, not necessarily but preferably, have the same thickness among one another.

The carrier module 38 is preferably formed in an L shape, as is the case with the exemplary embodiment. In this connection, the carrier module 38 has two first and second carrier module limbs 84, 85 aligned at right angles to one another. These two carrier module limbs 84, 85 delimit, on two sides, a receiving region 86, in which the control unit 22 fastened to the carrier module 38, is placed.

The carrier module limbs 84, 85 have in each case an inner surface 84*a*, 85*a* facing the receiving region 86 and an outer surface 84*b*, 85*b* facing away from the receiving region 86 and opposed in this regard.

The control unit interface 82 is provided on the two inner surfaces 84*a*, 85*a* and is expediently composed of a first interface section 42*a* arranged on the inner surface 84*a* of the first carrier module limb 84 and a second interface section 42*b* arranged on the inner surface 85*a* of the second carrier module limb 85. While the first interface section 42*a* is used only for the mechanical fixing of the control unit 22, the entire fluid connection between the control unit 22 and the carrier module 38 takes place via the second interface section 42*b*.

The installation interface 63 formed on the control unit housing 32 has a first interface section 63*a* abutting on the first interface section 42*a* of the first carrier module limb 84 and a second interface section 63*b* abutting on the second interface section 42 of the second carrier module limb 85. The channel mouths 65 of the control unit working channels 64*a*, 64*b* and also the channel mouths, assigned to the transition regions 25*c*, 75*a*, of channel sections 76, 25*a*, running in the control unit 22, of the air supply channel 24 and of the air outlet channel 25 are located on this second interface section 63*b*.

The two interface sections 63*a*, 63*b* are preferably located on two outer surface sections of the control unit housing 32 aligned at right angles to one another. The control unit 22 is for example tensioned with the carrier module 38 by means of fastening screws.

The extension interface 43 serving for the installation of the extension module arrangement 39 is located on the outer surface 85*b* of the second carrier module limb 85. The actuator mounting interface 18 is located on the outer surface 84*b* of the first carrier module limb 84.

Each working channel 27*a*, 27*b* passes through both the first carrier module limb 84 and the second carrier module limb 85. It extends in the first carrier module limb 84 with the two second carrier module channel sections 57*a*, 57*b* and in the second carrier module limb 85 with the two first carrier module channel sections 56*a*, 56*b*.

In the case of an exemplary embodiment not illustrated, the actuator mounting interface 18 is formed by the front surface, facing away from the carrier module 38, of the extension module 44 spaced furthest from the control unit 22. In this case, the controller 3 is installed with the extension module arrangement 39 on the actuator 5 such that the working channels 27*a*, 27*b* do not have to be guided through the extension module arrangement 39 in a U shape. In the case of such a configuration, it is in any case possible in relation to an L-shaped carrier module 38 to provide the extension interface 43 on the outer surface 84*b* of the first carrier module limb 84. The fluid channels arranged in the carrier module 38 are in this case guided in particular such that they do not open out to the outer surface 85*b* of the second carrier module limb 85.

The first carrier module limb 84 can, according to the illustrated exemplary embodiment, have a through-hole 87 through which a feedback member 88 movement-coupled to the actuating unit 14 of the actuator 5 protrudes, said feedback member interacting with the feedback means 36 of the control unit 22 to generate the feedback signals required for regulating the position.

The controller 3 is, owing to the variety of possibilities of flanging together the modules belonging to it, configurable in a very variable manner.

The carrier module 38 can in principle be configured in multiple parts, but preferably consists of a single-piece body.

The extension modules 44 are preferably formed in plate-shaped or block-shaped manner. They expediently have a polygonal and in particular rectangular contour, but can certainly also have an at least partially round contour. The contour designates the outer contour of the extension modules 44 oriented at right angles to the series direction 45.

The series direction 45 of the extension modules 44 extends, in the case of the exemplary embodiment, linearly and preferably at right angles to the surface of the extension interface 43. The series direction 45 preferably runs at a right angle to the longitudinal axis 89 of the second carrier module limb 85. If the extension module arrangement 39, according to an exemplary embodiment not illustrated, is installed on the outer surface 84*b* of the first carrier module limb 84, the series direction 45 preferably runs at right angles to the longitudinal axis 90 of the first carrier module limb 84.

In the case of an exemplary embodiment not shown, at least one extension module 44 has, on a side surface oriented at right angles to the series direction 45, an additional interface, on which an additional module can be installed in a preferably detachable manner. The extension module arrangement 39 can, aside from the extension modules 44, also contain additional modules serving to provide additional functions, which can be installed on the additional interfaces.

In the case of an exemplary embodiment also not illustrated, at least one coupling interface 82 is located on at least one extension module 44 on a side surface oriented at right angles to the series direction 45 indicated in the drawing. This provides the possibility of flanging together the extension modules 44 in a non-linear series. This allows an individual arrangement of the extension modules 44 to adapt to possibly narrowed space conditions at the usage location of the controller 3.

The invention claimed is:

1. An electropneumatic controller, which is designed to control a pneumatic actuator, comprising an actuator mounting interface designed for mounting on the pneumatic actuator to be controlled, further comprising an electropneumatic control unit, which contains a control electronics designed to process feedback signals of the actuator and which contains control valve means electrically actuatable by the control electronics, and comprising at least one working channel, which, is connected to the control valve means and, has a main working outlet serving to pneumatically connect to an actuating chamber of the actuator to be controlled, wherein the controller comprises a carrier module, which has a control unit interface and, a separate extension interface, wherein the control unit is mounted on the control unit interface and wherein an extension module arrangement having at least one extension module is mounted on the extension interface independently of the control unit, said extension module arrangement and the carrier module being passed through by the at least one working channel.

2. The controller according to claim 1, wherein the controller has two working channels and two main working outlets.

3. The controller according to claim 1, wherein the actuator mounting interface is arranged on the carrier module separate from the control unit interface and from the extension interface.

4. The controller according to claim 1, wherein the main working outlet of each working channel is formed on the carrier module.

5. The controller according to claim 4, wherein the actuator mounting interface is arranged on the carrier module separate from the control unit interface and from the extension interface, wherein the main working outlet of each working channel is arranged directly on the actuator mounting interface such that a direct fluid connection of each main working outlet is present with the actuator in the state of the controller being mounted on an actuator by means of the actuator mounting interface.

6. The controller according to claim 1, wherein the carrier module is formed in an L shape and has two carrier module limbs at right angles to one another, which together delimit a receiving region for the control unit on two sides, wherein the control unit interface is formed on the inner surface of at least one of the carrier module limbs facing the receiving region and wherein the extension interface is formed on the outer surface of one of the carrier module limbs facing away from the receiving region.

7. The controller according to claim 6, wherein the control unit interface has two interface sections, wherein on the inner surface of each carrier module limb, one of the two interface sections is arranged and wherein the control unit is mounted to both interface sections.

8. The controller according to claim 6, wherein each working channel passes through at least one of the two carrier module limbs.

9. The controller according to claim 6, wherein the extension interface is formed on the outer surface of one of the two carrier module limbs and wherein one or both of the actuator mounting interface and of the main working outlet of at least one working channel is formed on the outer surface of the other one of the two carrier module limbs.

10. The controller according to claim 1, wherein the control unit has a control unit housing, inside of which the control electronics and the control valve means are housed in a manner shielded from the environment.

11. The controller according to claim 1, wherein the control electronics has at least one feedback signal input suitable for receiving feedback signals of the actuator.

12. The controller according to claim 11, wherein the control unit has a control unit housing, inside of which the control electronics and the control valve means are housed in a manner shielded from the environment, wherein the control unit is equipped with feedback means connected to the feedback signal input by means of signalling technology and serving to generate feedback signals of the actuator, wherein the feedback means are arranged in the control unit housing, wherein the carrier module has a through-hole, through which a feedback member interacting with the feedback means protrudes, which is movement-coupled with a movable actuating unit of the actuator or is directly formed by such an actuating unit.

13. The controller according to claim 1, wherein the control unit is formed as a positioner unit, the control electronics of which has a closed-loop control function that is a position regulation function.

14. The controller according to claim 1, wherein each working channel has an extension working channel passing through the extension module arrangement, which is fluidically connected on the extension interface, on one side, with a pneumatic extension working outlet communicating with the control valve means and, on the other side, with an extension working inlet communicating with the pneumatic main working outlet.

15. The controller according to claim 14, wherein an extension module of the extension module arrangement is designed as a diverting module diverting the extension working channel from the extension working outlet back to the extension working inlet.

16. The controller according to claim 1, wherein at least one extension module is designed as a functional module by which the pressurised air flowing in the extension module arrangement during operation of the controller can be influenced or which can in turn be influenced by this flowing pressurised air.

17. The controller according to claim 16, wherein the extension module arrangement has a plurality of functional modules arranged in series and having different functionalities wherein among the functional modules there is provided at least one module selected from the group consisting of an air treatment module and a display module and a restrictor module and an interruption module and a manual actuation module and an emergency shut-off module and a booster module and an air input module.

18. The controller according to claim 1, wherein an air input connection is provided on the carrier module and/or on the extension module arrangement, said air input connection communicating with an extension air supply channel passing through the extension module arrangement, said extension air supply channel being fluidically connected across the carrier module to the control valve means located in the control unit to supply them with pressurised air.

19. A process control device, comprising a pneumatic actuator and an electropneumatic controller for controlling the pneumatic actuator, wherein the controller comprises an actuator mounting interface by which it is mounted on the pneumatic actuator, wherein the controller further comprises an electropneumatic control unit, which contains a control electronics designed to process feedback signals of the actuator and which contains control valve means electrically actuatable by the control electronics, and wherein the controller comprises at least one working channel, which is connected to the control valve means and has a main working outlet serving to pneumatically connect to an actuating chamber of the actuator to be controlled, wherein the controller comprises a carrier module, which has a control unit interface and a separate extension interface, wherein the control unit is mounted on the control unit interface and wherein an extension module arrangement having at least one extension module is mounted on the extension interface independently of the control unit, said extension module and the carrier module arrangement being passed through by the at least one working channel.

20. The process control device according to claim 19, wherein the actuator is part of a process valve and is used to actuate a valve fitting of the process valve.

* * * * *